US009277791B2

(12) United States Patent
Yue et al.

(10) Patent No.: US 9,277,791 B2
(45) Date of Patent: Mar. 8, 2016

(54) ADJUSTABLE BAND MECHANISM

(71) Applicant: Microsoft Technology Licensing, LLC, Redmond, WA (US)

(72) Inventors: Kok Liang Yue, Sammamish, WA (US); Stephen John Minarsch, Seattle, WA (US); Byung Joo Cho, Bellevue, WA (US); Scott F. Williams, Redmond, WA (US); Jason Lin, Redmond, WA (US); Gregory Kim Justice, Redmond, WA (US); Thomas E. McCue, Jr., Vancouver, WA (US); Scott Dallmeyer, Seattle, WA (US); Mark Shintaro Ando, Seattle, WA (US); Quintin Morris, Issaquah, WA (US)

(73) Assignee: MICROSOFT TECHNOLOGY LICENSING, LLC, Redmond, WA (US)

( * ) Notice: Subject to any disclaimer, the term of this patent is extended or adjusted under 35 U.S.C. 154(b) by 0 days.

(21) Appl. No.: 14/591,835

(22) Filed: Jan. 7, 2015

(65) Prior Publication Data

US 2016/0015136 A1 Jan. 21, 2016

Related U.S. Application Data

(60) Provisional application No. 62/027,156, filed on Jul. 21, 2014.

(51) Int. Cl.

| | |
|---|---|
| ***A44C 5/20*** | (2006.01) |
| ***A44C 5/00*** | (2006.01) |
| ***A44B 11/25*** | (2006.01) |

(52) U.S. Cl.

CPC ..... *A44C 5/2071* (2013.01); *A44B 11/2584* (2013.01); *A44C 5/0015* (2013.01)

(58) Field of Classification Search

CPC ..... A44C 5/2071; A44C 5/00; A44C 5/0007; A44C 5/0015; A44C 5/0053; A44C 5/0069; A44C 5/2052; A41F 1/008; A41F 9/002; A44B 11/00; A44B 11/266; A44B 11/258; A44B 11/2584

USPC ..... 24/68 B, 593.11, 272; 224/176, 221; 63/3.2

See application file for complete search history.

(56) References Cited

U.S. PATENT DOCUMENTS 74,354 A * 2/1868 Hatch ..... A44B 11/00 24/593.11

1,689,640 A 10/1928 Newman (Continued)

FOREIGN PATENT DOCUMENTS

CN 2662698 Y 12/2004

CN 201681263 U 12/2010

(Continued)

OTHER PUBLICATIONS

Fingas, Jon, "TomTom's new GPS watches track your heart rate without a chest strap (update: US pricing)", http://www.engadget.com/2014/04/03/tomtom-cardio-gps-watches/, Apr. 3, 2014, 10 pages.

(Continued)

*Primary Examiner* — Abigail Morrell

(74) *Attorney, Agent, or Firm* — Brandon Roper; Judy Yee; Micky Minhas

(57) ABSTRACT

A band clasp comprises a ratchet assembly at a first end of a band, the ratchet assembly including a plate having a rim that defines an aperture that extends along a length of the first end, the ratchet assembly further including a track that extends along the length of the first end beneath the plate, the track having a first side and a second side, the first side including a first plurality of teeth opposing a second plurality of teeth of the second side. The band clasp further comprises a pawl assembly disposed at a second end of the band opposite the first end, the pawl assembly including opposing pawls having an outward bias, the opposing pawls configured to engage the rim and opposing teeth of the track through the aperture to fasten the first end of the band to the second end of the band.

20 Claims, 5 Drawing Sheets

(56) References Cited

U.S. PATENT DOCUMENTS

| | | | | |
|---|---|---|---|---|
| 2,876,521 | A | 3/1959 | Legman | |
| 4,916,779 | A * | 4/1990 | Terada | A41F 1/008 24/171 |
| 5,184,352 | A * | 2/1993 | Maufette | A41F 9/002 24/579.09 |
| 5,490,685 | A * | 2/1996 | Kitayama | B62B 9/104 24/579.09 |
| 5,491,845 | A * | 2/1996 | Takimoto | A41F 9/002 2/338 |
| 6,175,729 | B1 | 1/2001 | He et al. | |
| 6,457,216 | B1 | 10/2002 | Lo | |
| 7,254,872 | B2 * | 8/2007 | Ross | A44B 11/001 24/163 K |
| 7,293,383 | B2 | 11/2007 | Fishman et al. | |
| 7,618,260 | B2 | 11/2009 | Daniel et al. | |
| 8,408,436 | B2 | 4/2013 | Berry et al. | |
| 2009/0010110 | A1 | 1/2009 | Chariton | |
| 2011/0098583 | A1 | 4/2011 | Pandia et al. | |
| 2012/0234045 | A1 | 9/2012 | Heiden et al. | |
| 2013/0044215 | A1 | 2/2013 | Rothkopf et al. | |
| 2013/0326790 | A1 | 12/2013 | Cauwels et al. | |

FOREIGN PATENT DOCUMENTS

| | | | |
|---|---|---|---|
| DE | 102011101905 | A1 | 11/2011 |
| EP | 1378185 | A1 | 1/2004 |
| FR | 2058819 | A5 | 5/1971 |
| WO | 8601983 | A1 | 4/1986 |
| WO | 2012061440 | A2 | 5/2012 |
| WO | 2014073255 | A1 | 5/2014 |

OTHER PUBLICATIONS

Goode, Lauren, "Samsung's New Gear Fit Needs to Work on the "Fit" Part", http://recode.net/2014/04/08/samsungs-new-gear-fit-needs-to-work-on-the-fit-part/, Apr. 8, 2014, 10 pages.

"Samsung Gear Fit, Gear 2 and Gear 2 Neo go on sale worldwide", NDTV Gadgets, http://gadgets.ndtv.com/others/news/samsung-gear-fit-gear-2-and-gear-2-neo-go-on-sale-worldwide-507220, Apr. 11, 2014, 3 pages.

Poeter, Damon, "Meet Simband, Samsung's Next-Gen Health Tracker", http://www.pcmag.com/article2/0,2817,2458663,00.asp, May 28, 2014, 5 pages.

Purcher, Jack, "Samsung Invents a New Wearable Device: The Smart Bangle", Published on: Jun. 14, 2014, Available at: http://www.patentlymobile.com/patent-bolt/2014/06/samsung-invents-a-new-wearable-device-the-smart-bangle.html.

"Watch Buckles and Clasps", Published on: Nov. 18, 2009, Available at: http://precisiontimeco.com/watch-clasps/.

U.S. Appl. No. 14/292,484, Justice, et al., "Ring-Shaped Skin Sensor", Filed Date: May 30, 2014.

U.S. Appl. No. 14/292,447, Justice, et al., "Optical Pulse-Rate Sensor Pillow Assembly", Filed Date: May 30, 2014.

U.S. Appl. No. 14/292,106, Justice, et al., "Wearable Electronic Device", Filed Date: May 30, 2014.

U.S. Appl. No. 14/292,551, Justice, et al., "Wearable Electronic Device", Filed Date: May 30, 2014.

U.S. Appl. No. 14/292,472, Justice, et al., "Battery Compartments for Wearable Electronic Device", Filed Date: May 30, 2014.

U.S. Appl. No. 14/292,561, Justice, et al., "Optical Pulse-Rate Sensing", Filed Date: May 30, 2014.

U.S. Appl. No. 14/332,163, Mahanfar, et al., "Antenna for Electronic Device", Filed Date: Jul. 15, 2014.

BlueDial, "Watch Buckles and Clasps", http://www.bluedial.com/clasps.htm, Mar. 27, 2009, 5 pages.

CountyComm, "Maratac™ Silicone Rubber Deployment Watch Bands", http://www.countycomm.com/siliconebands.html, Aug. 19, 2011, 2 pages.

"Watch Band PU Waterproof Strap Adjustable Stainless Steel Deployment Buckle Black 22 millimeter", Feb. 28, 2012, http://www.amazon.com/Waterproof-Adjustable-Stainless-Deployment-millimeter/dp/B004RQ5A7Q, 7 pages.

Travers Tool Co. Inc., "Small Silicon Respirator Quick latch Aosafety", Dec. 6, 2013, http://www.travers.com/88454-96-002-018, 1 page.

ISA European Patent Office, International Search Report and Written Opinion Issued in PCT Application No. PCT/US2015/041047, Sep. 24, 2015, WIPO, 10 pages.

* cited by examiner

ADJUSTABLE BAND MECHANISM

CROSS REFERENCE TO RELATED APPLICATIONS

This application claims priority to U.S. Provisional Patent Application No. 62/027,156, filed Jul. 21, 2014, and entitled "ADJUSTABLE BAND MECHANISM", the entirety of which is hereby incorporated herein by reference.

BACKGROUND

Many wristbands provide a mechanism with which the size of the wristband may be adjusted to accommodate wide variation in human wrist size and provide a snug but comfortable fit. In some wristbands, links are added or removed to adjust fit. Other wristbands utilize a flexible elastic band.

SUMMARY

One embodiment of this disclosure provides a band clasp. The band clasp comprises a ratchet assembly at a first end of a band, the ratchet assembly including a plate having a rim that defines an aperture that extends along a length of the first end, the ratchet assembly further including a track that extends along the length of the first end beneath the plate, the track having a first side and a second side, the first side including a first plurality of teeth opposing a second plurality of teeth of the second side. The band clasp further comprises a pawl assembly disposed at a second end of the band opposite the first end, the pawl assembly including opposing pawls having an outward bias, the opposing pawls configured to engage the rim and opposing teeth of the track through the aperture to fasten the first end of the band to the second end of the band.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

BRIEF DESCRIPTION OF THE DRAWINGS

FIG. 2 shows the band clasp of the wearable sensor system of

FIG. 1A.

DETAILED DESCRIPTION

Figure 1B:
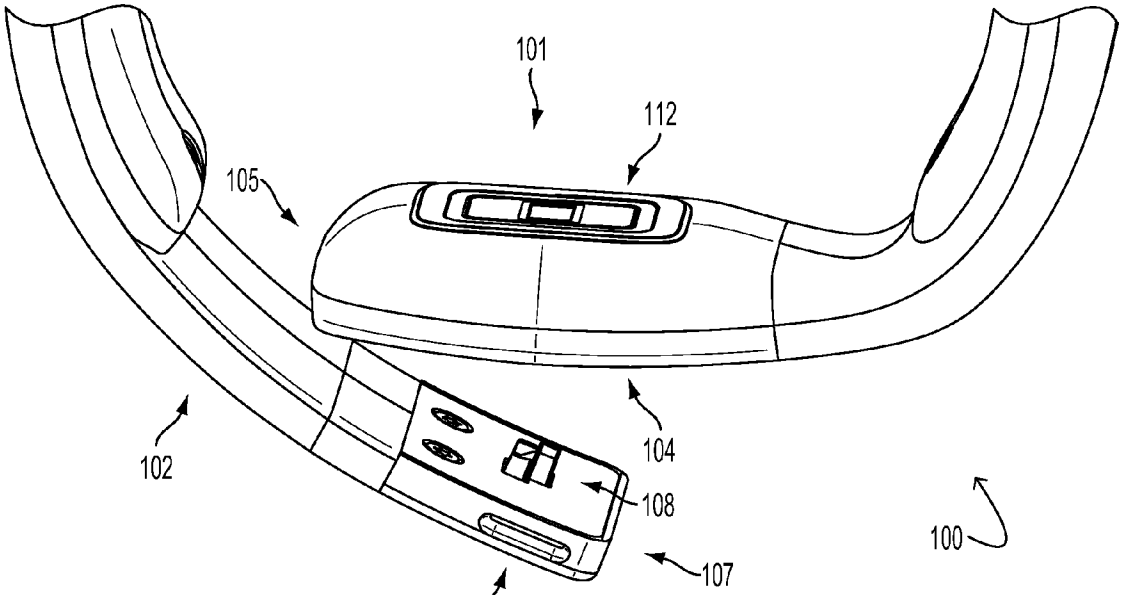
FIG. 1B is a partial view of a band clasp of the wearable sensor system of FIG. 1A.
Figure 1A:
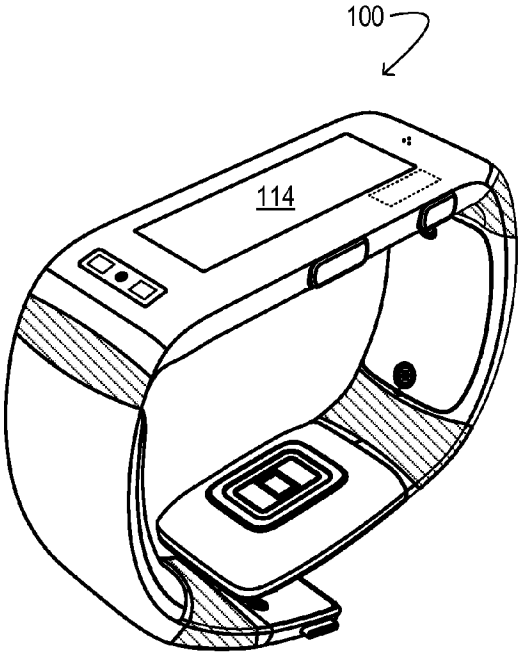
FIG. 1A shows an example wearable sensor system.

FIG. 1A is a view of an example wearable sensor system 100. FIG. 1B is a partial view of a band clasp 101 of the wearable sensor system 100. The wearable sensor system 100 includes a band 102 that is operatively attached to band clasp 101 and that supports components of the band clasp at two ends—specifically, a ratchet assembly 104 at a first end 105 and a pawl assembly 106 at a second end 107 opposite the first end. In some examples, band 102 is comprised of an elastomeric material (e.g., polyisoprene, butyl rubber, ethylene propylene rubber, silicone rubber) that facilitates a snug but comfortable fit when surrounding a portion of a human limb (e.g., wrist) or other object when the wearable sensor system 100 is positioned in a secure, closed state affixing the system to the human limb portion or other object. This secure state may be achieved by engaging ratchet assembly 104 with pawl assembly 106, thereby fastening the first end 105 of the band 102 to the second end 107 of the band. As described in further detail below, pawl assembly 106 includes opposing pawls 108 that may be engaged with ratchet assembly 104 to facilitate fastening of first end 105 to second end 107. In the depicted example, pawls 108 extend substantially perpendicularly from second end 107 of band 102.

The wearable sensor system 100 further includes a heart rate sensor (HRS) 112 positioned at first end 105 and configured to sense the heart rate of a user wearing the wearable sensor system 100. To perform heart rate sensing, HRS 112 is placed in contact with the skin of the user (e.g., with a surface of the user's wrist). HRS 112 may use various suitable heart rate sensing technologies to sense the heart rate of the user wearing the wearable sensor system 100—for example, the HRS may probe the wearer's skin with visible light of wavelengths strongly absorbed by hemoglobin. As the capillaries below the skin fill with blood on each contraction of the heart muscle, more of the probe light is absorbed; as the capillaries empty between contractions, less of the probe light is absorbed. Thus, by measuring the periodic attenuance of the probe light, the wearer's pulse rate can be determined. As described in further detail, HRS 112 may be maintained in contact with the wearer's skin during adjustment (e.g., tightening, loosening) of band 102, providing continued heart rate sensing even while adjusting the fit of the band.

As shown in FIG. 1A, the wearable sensor system 100 may further include a display carrier module 114 positioned in band 102 substantially opposite HRS 112, when the band is in a closed, looped state. In some examples, band 102 may comprise two discrete segments (e.g., a first band segment including first end 105 and a second band segment including second end 107) which may be joined together by and/or at display carrier module 114. Band 102 may thus be operatively attached to display carrier module 114. Accordingly, display carrier module 114 may be inserted, removed, or replaced in band 102. The display carrier module 114 may include various electronic and/or logic components such as a logic machine and a data-storage machine. The data-storage machine may hold data and instructions, the latter of which may be executed by the logic machine to enact various computing device functionalities.

Examples of suitable data-storage and logic machines are described below with reference to FIG. 5. As such, the wearable sensor system 100 may be referred to as a wearable (e.g., wrist-worn) computing device and/or a wearable sensory-and-logic system. The display carrier module 114 may further include a display device (e.g., LCD, OLED) configured to output visual information that may be observed by the user. As one non-limiting example, the display device may provide an indication of time. As such, in this example the wearable sensor system 100 may be referred to as a watch. A mechanism indicating time may be mechanical, analog, digital, or another suitable type.

In some implementations, HRS 112 may cooperate with display carrier module 114 to enable wearers of the wearable sensor system 100 to track their fitness (e.g., heart rate measured by the HRS). In particular, display carrier module 114 may include a fitness tracking computing device, comprising a logic machine and a data-storage machine that receives measurements from HRS 112 and provides output indicative of the HRS measurements to the display device in the display carrier module.

While the wearable sensor system 100 is shown as including HRS 112, it will be appreciated that other sensors may be included in addition or in lieu of the HRS, including but not limited to a galvanic skin-response sensor, a skin temperature sensor, and an ambient temperature sensor. One or more of such sensors, in addition to other componentry that may be included in the wearable sensor system 100 (e.g., a GPS receiver, microphone, speaker, communication port, visible-light sensor, ultraviolet light sensor) may interact cooperatively to collect input and provide representative output to the user (e.g., via the display device and/or speaker). Further, one or more such sensors may be positioned in first end 105 or various other suitable locations in the wearable sensor system 100.

Figure 2:
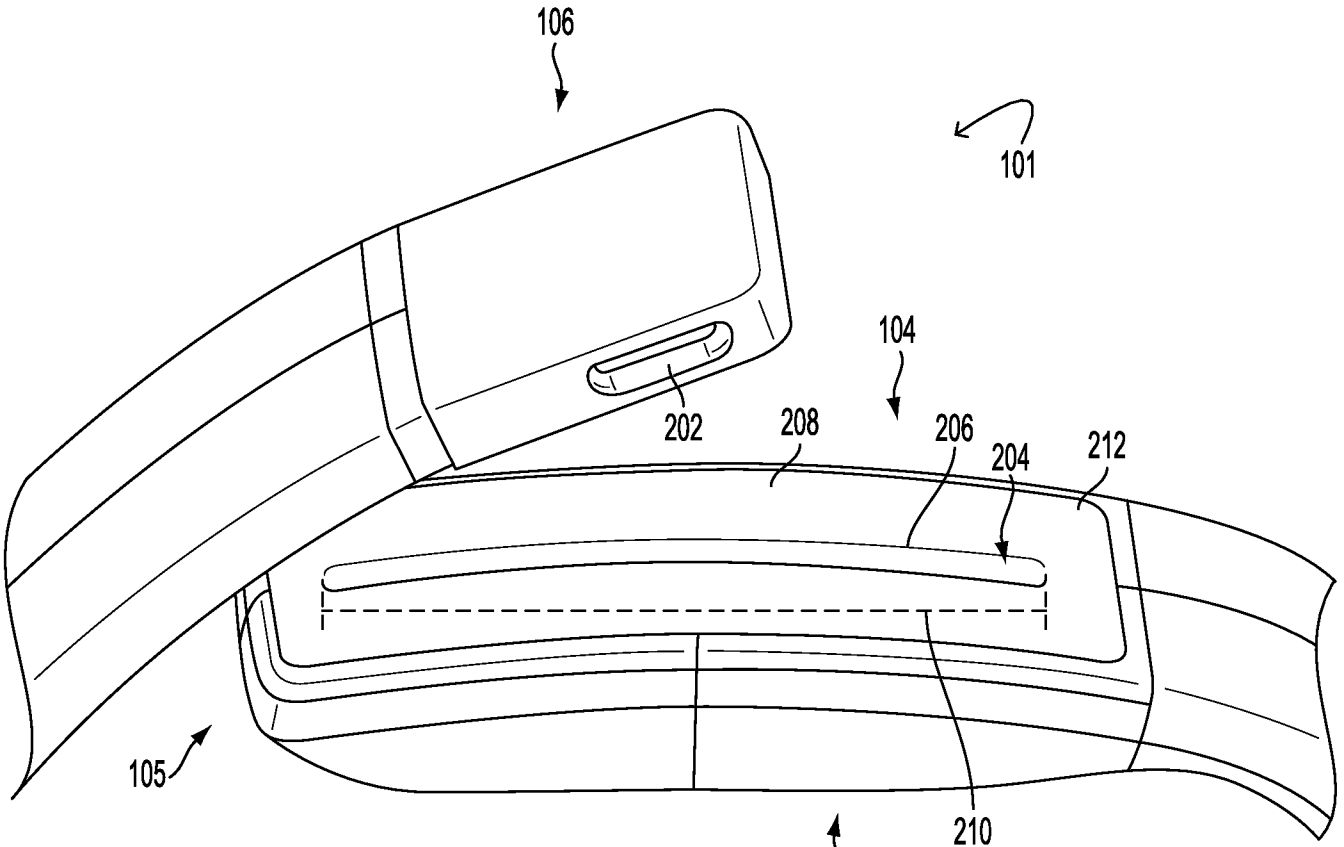

FIG. 2 is a perspective view of band clasp 101 of the wearable sensor system of FIG. 1. Clasp 101 includes a pawl release 202, which in the depicted implementation includes two side buttons positioned on opposite sides of pawl assembly 106. In this example, pawl release 202 may be actuated in a lateral and inward direction perpendicular to a longitudinal direction along which band 102 may be tightened and/or lengthened. As described in further detail below, actuation of pawl release 202 in this manner in turn actuates pawls 108 (FIG. 1B), allowing the pawls to be disengaged from ratchet assembly 104, unlocking clasp 101, disengaging first end 105 from second end 107, and allowing a user to remove the wearable sensor system 100 from his or her body. In the depicted implementation, pawl release 202 and pawls 108 are integrated into a single component. Ratchet assembly 104 may be accessed by extending pawls 108 through an aperture 204 defined by a rim 206 of a plate 208. In this example, aperture 204 is a hollow opening extending along a length 210 of first end 105. Thus, aperture 204 may be visually concealed from visual perception by the user, enhancing the apparent industrial design of the wearable sensor system 100.

FIG. 2 also illustrates the positioning of aperture 204 relative to other components in clasp 101. For example, aperture 204 may be positioned along an outward face 212 of first end 105, whereas a component such as HRS 112 may be positioned along an inward face 214 of the first end, the inward face opposing the outward face. With first end 105 fastened to second end 107, pawls 108 (FIG. 1B) of pawl assembly 106 may extend through aperture 204 and outward face 212 toward inward face 214. Moreover, with first end 105 fastened to second end 107, ratchet assembly 104 may be in opposing abutment (e.g., physical contact) with pawl assembly 106.

Figure 3B:
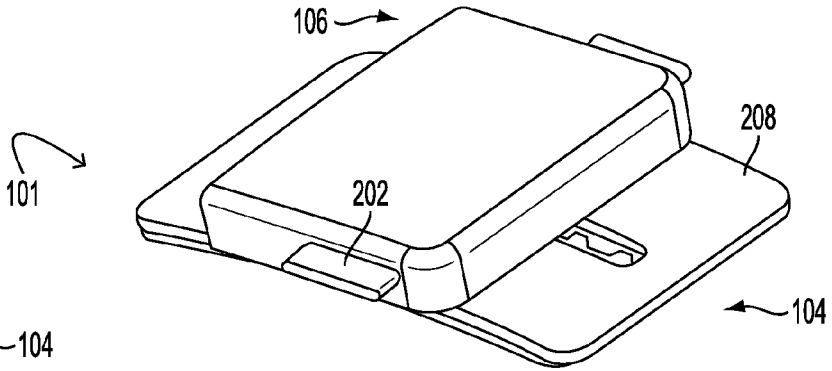
FIGS. 3A-C show the band clasp of the wearable sensor system of FIG. 1A in various states.
Figure 3A:
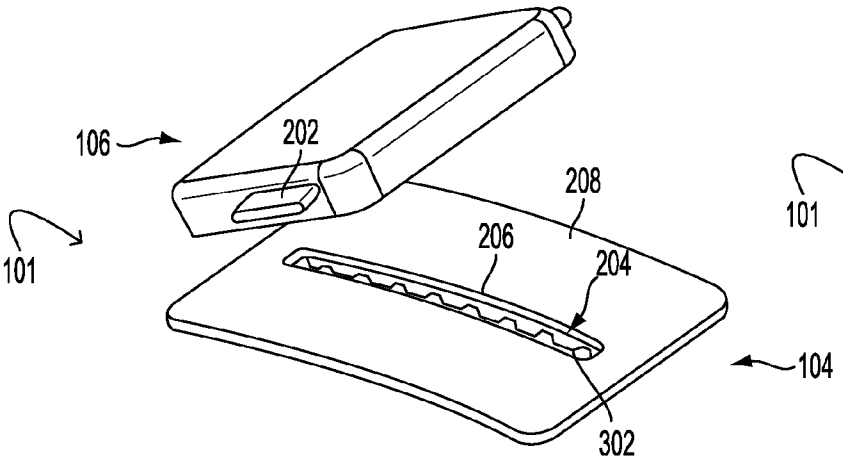
Figure 3C:
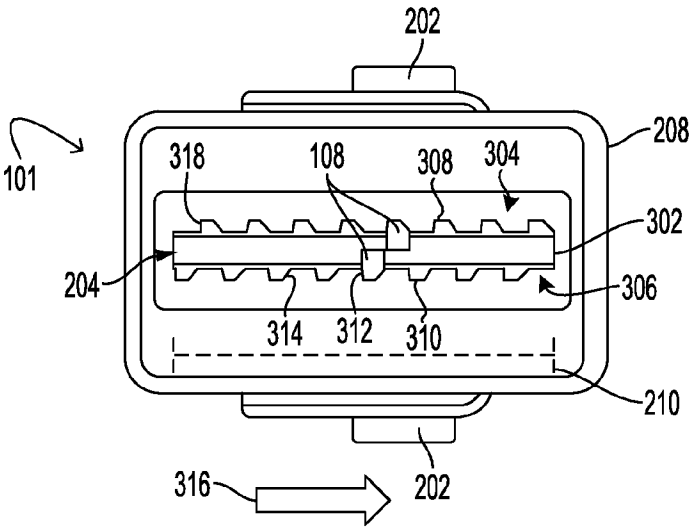

FIGS. 3A-C show band clasp 101 of the wearable sensor system of FIG. 1 in various states. In particular, FIGS. 3A and 3B show ratchet assembly 104 and pawl assembly 106 in an open, disengaged state and a closed, engaged state, respectively. The closed, engaged state may be achieved by extending pawls 108 (FIG. 1B) of pawl assembly 106 through aperture 204 of plate 208 and engaging the pawls with a track 302 positioned beneath the plate. Pawls 108 (FIG. 1B) may be snapped into track 302 through aperture 204 at virtually any position along the track without actuating pawl release 202. Snap-in in this manner facilitates easy and rapid securement of the wearable sensor system 100 to a wearer. In contrast, pawl release 202 is actuated to disengage pawls 108 from track 302 and release the wearable sensor system 100 from its connection to the wearer.

FIG. 3C illustrates track 302 and the engagement of pawls 108 thereto. FIG. 3C particularly shows a bottom view of plate 208 and track 302; the depicted surface of the plate may be in contact with a wearer's skin when clasp 101 is in the closed, secure state, for example. As with aperture 204, track 302 extends along length 210 of first end 105 (FIG. 1B) beneath plate 208. Track 302 includes a first side 304 and a second side 306, where the first side includes a first plurality of teeth (e.g., first tooth 308) opposing a second plurality of teeth (e.g., second tooth 310) of the second side. Pawls 108 may have an outward bias, such that when inserted through aperture 204 and into track 302, the pawls expand outwardly, engaging the teeth of the track on both sides as shown in FIG. 3C.

Each pawl 108 includes a tapered head that automatically inwardly deflects that opposing pawl in response to the tapered head extending through aperture 204. The tapered head of each pawl 108 comes into contact with rim 206 as ratchet assembly 104 is engaged with pawl assembly 106, cooperating with the rim to deflect the pawl inward as the pawl is also pushed downward into aperture 204. Each tapered head may extend along a portion of its respective pawl 108 such that when the pawls are inserted through aperture 204 by a threshold amount the outward bias of the pawls pushes the pawls into respective teeth and into engagement with track 302. By positioning pawls 108 such that their tapered heads come into contact with rim 206 when the pawls begin to be inserted into aperture 204, ratchet assembly 104 may be snapped-in to pawl assembly 106 without actuating pawl release 202 as described above.

Continuing with FIG. 3C, each pawl 108 includes a catch (e.g., catch 312) that engages plate 208 and resists that pawl from being removed from aperture 204, once the pawls have been inserted through the aperture. As such, the geometry of the teeth of track 302 may be adapted to the geometry of the catches; for example, the teeth may be sized slightly larger than the catches such that, when pawls 108 are engaged with the track, the catches remain in at least partial abutment with respective teeth and resist removal (e.g., via a transverse force into the page of FIG. 3C) from the track by maintaining contact with plate 208. Pawl release 202, however, may move each opposing pawl 108 inward (e.g., laterally) so as to disengage the catch 312 of that pawl from plate 208 and allow that pawl to be removed through aperture 204.

Other features of clasp 101 define the movement of pawls 108. In particular, each tooth of track 302 includes a ramp portion (e.g., ramp portion 314) that automatically inwardly deflects an opposing pawl 108 in response to an effective length of band 102 (FIG. 1B) being shortened. In some examples, the effective length of band 102 (FIG. 1B) may be shortened by advancing pawl assembly 106 (FIGS. 3A and 3B) along a longitudinal direction (e.g., substantially parallel to a direction represented by an arrow 316) without actuating pawl release 202. As the effective band length is shortened in this way, pawls 108 push against respective ramp portions 314, which guide the pawls inward and allow the pawls to disengage from the teeth of track 302 with which they were initially engaged, and to engage different teeth in a different longitudinal position. In some implementations, the catches 312 of pawls 108 may remain engaged with plate 208 as the ramp portions 314 automatically inwardly deflect the pawls, allowing the position of the pawls to be varied while maintaining their engagement with the track.

It will be appreciated that the "effective length" of band 102 as used herein may refer to the degree to which the band is tightened—e.g., the amount by which pawls 108 are advanced along the longitudinal direction within track 302. A relatively greater effective length may thus refer to a relatively looser fit when band 102 is secured, whereas a relatively lesser effective length may refer to a relatively tighter fit.

Each tooth of track 302 further includes a stop (e.g., stop 318) that engages a pawl 108 (e.g., particularly catch 312) to resist the effective length of band 102 (FIG. 1B) from being lengthened. Once pawls 108 are engaged with track 302, stops 318 abut and prevent the pawls from being advanced in a loosening direction opposite the tightening direction—e.g., the stops prevent the pawls from being advanced in a longitudinal direction substantially antiparallel to the direction indicated by arrow 316. As such, actuation of pawl release 202 may be required in some implementations to move pawls 108 inward so as to disengage the pawls from stops 318 and to allow the effective length of band 102 (FIG. 1B) to be lengthened.

Thus, the attachment of ratchet assembly 104 to pawl assembly 106 (and the engagement of pawls 108 with track 302), as well as tightening of band 102, may be achieved without actuation of pawl release 202. Conversely, actuation of pawl release 202 disengages ratchet assembly 104 from pawl assembly 106 (and disengages pawls 108 from track 302), thereby loosening band 102. Such a configuration may allow wearers of band 102 to rapidly secure the band to their bodies and achieve a desired tightness with minimal manipulation, while preventing errant loosening or disengagement of the band.

Various modifications to the wearable sensor system 100 are possible without departing from the scope of this disclosure. For example, ratchet assembly 104 and pawl assembly 106 may be transposed—that is, as seen in FIGS. 3A and 3B, ratchet assembly 104 may be positioned above pawl assembly 106, with pawls 108 being engaged with the ratchet assembly in an upward direction. Moreover, pawls 108 may be imbued with an inward bias rather than an outward bias. In this example, pawls 108 move toward the center of an (e.g., laterally) outward facing track to facilitate engagement of ratchet assembly 104 with pawl assembly 106.

Figure 4:
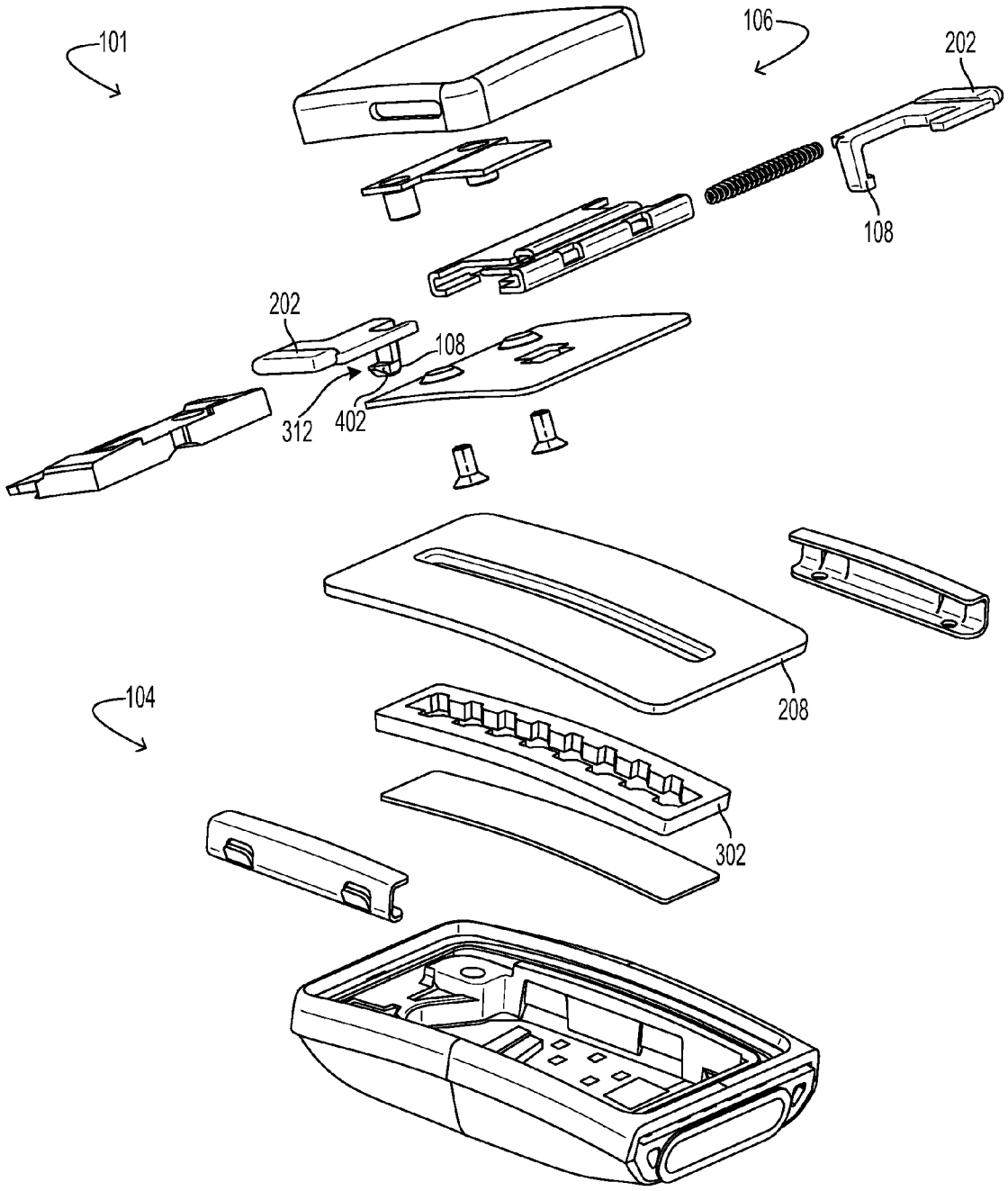
FIG. 4 is an exploded view of the band clasp of FIG. 2.

FIG. 4 is an exploded view of band clasp 101 of FIG. 2. As shown, ratchet assembly 104 and pawl assembly 106 include a variety of components, such as a clasp housing, inner plate, strap insert, screws, rack cover, rack, slotted inner band, inner band snaps, spring-box lower case, coil spring, button pawl, and spring-box cover. The structure of track 302 may be installed and retained in ratchet assembly 104 using sheet metal snap fits, for example. The snap fits may be designed to achieve a permanent installation and be strong enough to resist normal wear and tear as well as reasonable abuse. Further, pawls 108 may be captured and tensioned by a spring-box mechanism that imbues band clasp 101 with an elegant aesthetic appearance. Coil springs may also be included in the spring-box mechanism which bias pawl release 202 outwardly. The spring-box mechanism may be enclosed by the clasp housing which is attached to an elastomeric segment (e.g., a portion of band 102 of FIG. 1B), which is in turn attached to the structure of the wearable sensor system 100.

FIG. 4 also illustrates aspects of pawls 108. As shown therein for one such pawl 108, the pawl includes a tapered head 402 that cooperates with rim 206 (FIG. 2) to facilitate band tightening without actuation of pawl release 202 as described above. FIG. 4 also shows catch 312 of pawl 108, which as described above may maintain engagement between the pawl and plate 208, thereby preventing its release from the track without actuation of pawl release 202, and may further abut against stops (e.g., stop 318 of FIG. 3C) of the track, allowing the pawls to be advanced in a tightening direction without actuation of the pawl release and preventing pawl movement in a loosening direction without actuation of the pawl release.

As shown and described, the wearable sensor system 100 affords a method of affixing a wristband to a wearer in an easy, rapid manner that does not involve actuation of buttons. Such method of "snap-in" is implemented in a physical design that imparts a clean industrial design to the wearable sensor system 100 without using screws. Conversely, band 102 of the wearable sensor system 100 may be loosened via pawl release actuation and not removal or adjustment of band links. This may maximize the duration in which an HRS (and/or other skin contact sensors) remain in contact with the skin of the wearer, maximizing the duration in which sensing is provided.

It will be appreciated that the approaches described herein may be applied to other wristbands and bands in general that do not incorporate sensing and/or computing componentry. Rather, rapid band securement as disclosed herein may be applied to virtually any band for which securement to some object is desired.

As evident from the foregoing description, the methods and processes described herein may be tied to a sensory-and-logic system of one or more machines. Such methods and processes may be implemented as a computer-application program or service, an application-programming interface (API), a library, firmware, and/or other computer-program product. FIGS. 1-4 show one, non-limiting example of a sensory-and-logic system to enact the methods and processes described herein. However, these methods and process may also be enacted on sensory-and-logic systems of other configurations and form factors, as shown schematically in FIG. 5.

Figure 5:
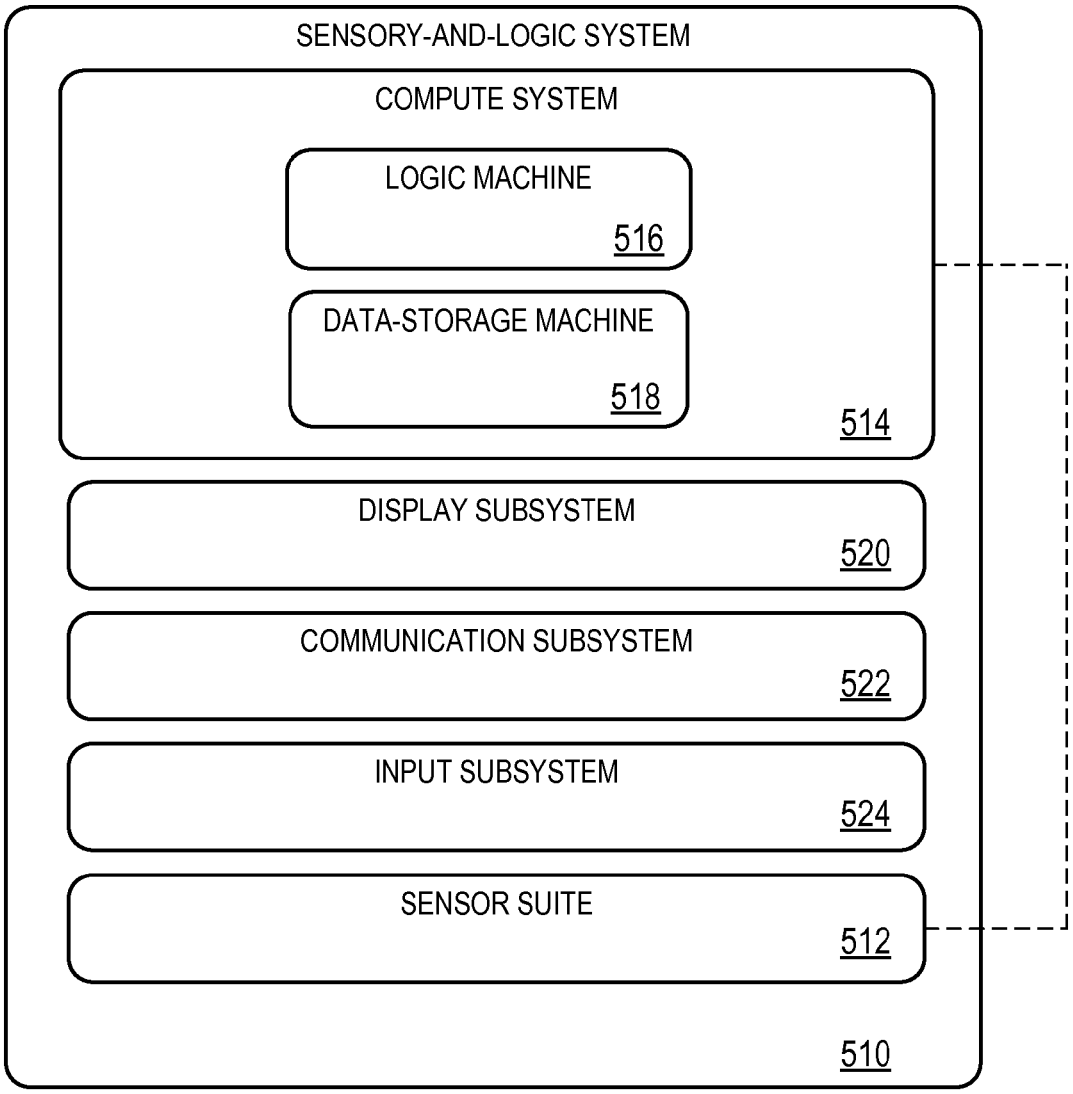
FIG. 5 schematically shows a form-agnostic sensory-and-logic system.

FIG. 5 schematically shows a form-agnostic sensory-and-logic system 510 that includes a sensor suite 512 operatively coupled to a compute system 514. The compute system includes a logic machine 516 and a data-storage machine 518. The compute system is operatively coupled to a display subsystem 520, a communication subsystem 522, an input subsystem 524, and/or other components not shown in FIG. 5.

Logic machine 516 includes one or more physical devices configured to execute instructions. The logic machine may be configured to execute instructions that are part of one or more applications, services, programs, routines, libraries, objects, components, data structures, or other logical constructs. Such instructions may be implemented to perform a task, implement a data type, transform the state of one or more components, achieve a technical effect, or otherwise arrive at a desired result.

Logic machine 516 may include one or more processors configured to execute software instructions. Additionally or alternatively, the logic machine may include one or more hardware or firmware logic machines configured to execute hardware or firmware instructions. Processors of the logic machine may be single-core or multi-core, and the instructions executed thereon may be configured for sequential, parallel, and/or distributed processing. Individual components of a logic machine optionally may be distributed among two or more separate devices, which may be remotely located and/or configured for coordinated processing. Aspects of a logic machine may be virtualized and executed by remotely accessible, networked computing devices in a cloud-computing configuration.

Data-storage machine 518 includes one or more physical devices configured to hold instructions executable by logic machine 516 to implement the methods and processes described herein. When such methods and processes are implemented, the state of the data-storage machine may be transformed—e.g., to hold different data. The data-storage machine may include removable and/or built-in devices; it may include optical memory (e.g., CD, DVD, HD-DVD, Blu-Ray Disc), semiconductor memory (e.g., RAM, EPROM, EEPROM), and/or magnetic memory (e.g., hard-disk drive, floppy-disk drive, tape drive, MRAM), among others. The data-storage machine may include volatile, non-volatile, dynamic, static, read/write, read-only, random-access, sequential-access, location-addressable, file-addressable, and/or content-addressable devices.

It will be appreciated that data-storage machine 518 includes one or more physical devices. However, aspects of the instructions described herein alternatively may be propagated by a communication medium (e.g., an electromagnetic signal, an optical signal) that is not held by a physical device for a finite duration.

Aspects of logic machine 516 and data-storage machine 518 may be integrated together into one or more hardware-logic components. Such hardware-logic components may include field-programmable gate arrays (FPGAs), program- and application-specific integrated circuits (PASIC/ASICs), program- and application-specific standard products (PSSP/ASSPs), system-on-a-chip (SOC), and complex programmable logic devices (CPLDs), for example.

Display subsystem 520 may be used to present a visual representation of data held by data-storage machine 518. This visual representation may take the form of a graphical user interface (GUI). As the herein described methods and processes change the data held by the storage machine, and thus transform the state of the storage machine, the state of display subsystem 520 may likewise be transformed to visually represent changes in the underlying data. Display subsystem 520 may include one or more display subsystem devices utilizing virtually any type of technology. Such display subsystem devices may be combined with logic machine 516 and/or data-storage machine 518 in a shared enclosure, or such display subsystem devices may be peripheral display subsystem devices. The display device housed in display carrier module 114 of FIG. 1A is an example of display subsystem 520.

Communication subsystem 522 may be configured to communicatively couple compute system 514 to one or more other computing devices. The communication subsystem may include wired and/or wireless communication devices compatible with one or more different communication protocols. As non-limiting examples, the communication subsystem may be configured for communication via a wireless telephone network, a local- or wide-area network, and/or the Internet.

Input subsystem 524 may comprise or interface with one or more user-input devices such as a keyboard, mouse, touch screen, or game controller. In some embodiments, the input subsystem may comprise or interface with selected natural user input (NUI) componentry. Such componentry may be integrated or peripheral, and the transduction and/or processing of input actions may be handled on- or off-board. Example NUI componentry may include a microphone for speech and/or voice recognition; an infrared, color, stereoscopic, and/or depth camera for machine vision and/or gesture recognition; a head tracker, eye tracker, accelerometer, and/or gyroscope for motion detection and/or intent recognition; as well as electric-field sensing componentry for assessing brain activity.

Sensor suite 512 may include one or more different sensors—e.g., a touch-screen sensor, push-button sensor, microphone, visible-light sensor, ultraviolet sensor, ambient-temperature sensor, contact sensors, optical pulse-rate sensor, accelerometer, gyroscope, magnetometer, and/or GPS receiver—as described above.

An example provides a band clasp comprising a ratchet assembly at a first end of a band, the ratchet assembly including a plate having a rim that defines an aperture that extends along a length of the first end, the ratchet assembly further including a track that extends along the length of the first end beneath the plate, the track having a first side and a second side, the first side including a first plurality of teeth opposing a second plurality of teeth of the second side, and a pawl assembly disposed at a second end of the band opposite the first end, the pawl assembly including opposing pawls having an outward bias, the opposing pawls configured to engage the rim and opposing teeth of the track through the aperture to fasten the first end of the band to the second end of the band. In such an example, the opposing pawls may alternatively or additionally extend substantially perpendicularly from the second end of the band. In such an example, each opposing pawl may alternatively or additionally include a tapered head that automatically inwardly deflects that opposing pawl in response to the tapered head extending through the aperture. In such an example, each opposing pawl may alternatively or additionally include a catch that engages the plate and resists that opposing pawl from being removed through the aperture. In such an example, the band clasp may alternatively or additionally comprise a pawl release that moves each opposing pawl inward so as to disengage the catch of that opposing pawl from the plate and allow that opposing pawl to be removed through the aperture. In such an example, each tooth of the track may alternatively or additionally include a ramp portion that automatically inwardly deflects an opposing pawl in response to an effective length of the band being shortened. In such an example, the catch may alternatively or additionally remain engaged with the plate as the ramp portion automatically inwardly deflects the opposing pawl. In such an example, each tooth of the track may alternatively or additionally include a stop that engages an opposing pawl to resist an effective length of the band from being lengthened. In such an example, the band clasp may alternatively or additionally comprise a pawl release that moves the opposing pawl inward so as to disengage the opposing pawl from the stop and allow the effective length of the band to be lengthened. Any or all of the above-described examples may be combined in any suitable manner in various implementations.

Another example provides a wearable device comprising a display carrier module, a band operatively attached to the display carrier module, and a band clasp operatively attached to the band, the band clasp including a ratchet assembly at a first end of the band, the ratchet assembly including a plate having a rim that defines an aperture that extends along a length of the first end, the ratchet assembly further including a track that extends along the length of the first end beneath the plate, the track having a first side and a second side, the first side including a first plurality of teeth opposing a second plurality of teeth of the second side, and a pawl assembly disposed at a second end of the band opposite the first end, the pawl assembly including opposing pawls having an outward bias, the opposing pawls configured to engage the rim and opposing teeth of the track through the aperture to fasten the first end of the band to the second end of the band. In such an example, the display carrier may alternatively or additionally be configured to provide an indication of time. In such an example, the display carrier may alternatively or additionally include a computing device. In such an example, the display carrier may alternatively or additionally include a fitness tracking computing device. In such an example, the wearable device may alternatively or additionally comprise a heart rate sensor. In such an example, the aperture may alternatively or additionally be positioned along an outward face of the first end of the band, and the heart rate sensor may alternatively or additionally be positioned along an inward face of the first end of the band, the inward face opposing the outward face with the first end of the band fastened to the second end of the band. In such an example, the ratchet assembly may alternatively or additionally be in opposing abutment with the pawl assembly with the first end of the band fastened to the second end of the band. Any or all of the above-described examples may be combined in any suitable manner in various implementations.

Another example provides a wearable sensor system comprising a display carrier module, a band operatively attached to the display carrier module, the band including a heart rate sensor positioned at a first end of the band, and a band clasp operatively attached to the band, the band clasp including a ratchet assembly at the first end of a band, the ratchet assembly including a plate having a rim that defines an aperture that extends along a length of the first end, the ratchet assembly further including a track that extends along the length of the first end beneath the plate, the track having a first side and a second side, the first side including a first plurality of teeth opposing a second plurality of teeth of the second side, and a pawl assembly disposed at a second end of the band opposite the first end, the pawl assembly including opposing pawls having an outward bias, the opposing pawls configured to engage the rim and opposing teeth of the track through the aperture to fasten the first end of the band to the second end of the band. In such an example, the display carrier may alternatively or additionally be configured to provide output indicative of measurement performed by the heart rate sensor. In such an example, the heart rate sensor may alternatively or additionally be positioned along an inward face of the first end of the band, and the track may alternatively or additionally be positioned along an outward face of the first end of the band, the outward face opposing the inward face and the pawl assembly with the first end fastened to the second end. In such an example, the ratchet assembly may alternatively or additionally be in opposing abutment with the pawl assembly with the first end fastened to the second end. Any or all of the above-described examples may be combined in any suitable manner in various implementations.

It will be understood that the configurations and approaches described herein are exemplary in nature, and that these specific implementations or examples are not to be taken in a limiting sense, because numerous variations are feasible. The specific routines or methods described herein may represent one or more processing strategies. As such, various acts shown or described may be performed in the sequence shown or described, in other sequences, in parallel, or omitted.

The subject matter of this disclosure includes all novel and non-obvious combinations and sub-combinations of the various processes, systems and configurations, and other features, functions, acts, and/or properties disclosed herein, as well as any and all equivalents thereof.

The invention claimed is:

1. A band clasp, comprising:

a ratchet assembly at a first end of a band, the ratchet assembly including a plate having a rim that defines an aperture that extends along a length of the first end, the ratchet assembly further including a track that extends along the length of the first end beneath the plate, the track having a first side and a second side, the first side including a first plurality of teeth opposing a second plurality of teeth of the second side; and a pawl assembly disposed at a second end of the band opposite the first end, the pawl assembly including opposing pawls having an outward bias, the opposing pawls configured to engage the rim and opposing teeth of the track through the aperture to fasten the first end of the band to the second end of the band.

2. The band clasp of claim 1, where the opposing pawls extend substantially perpendicularly from the second end of the band.

3. The band clasp of claim 1, where each opposing pawl includes a tapered head that automatically inwardly deflects that opposing pawl in response to the tapered head extending through the aperture.

4. The band clasp of claim 1, where each opposing pawl includes a catch that engages the plate and resists that opposing pawl from being removed through the aperture.

5. The band clasp of claim 4, further comprising a pawl release that moves a respective opposing pawl inward so as to disengage the catch of the respective opposing pawl from the plate and allow the respective opposing pawl to be removed through the aperture.

6. The band clasp of claim 4, where each tooth of the track includes a ramp portion that automatically inwardly deflects an opposing pawl in response to an effective length of the band being shortened.

7. The band clasp of claim 6, where the catch remains engaged with the plate as the ramp portion automatically inwardly deflects the opposing pawl.

8. The band clasp of claim 1, where each tooth of the track includes a stop that engages an opposing pawl to resist an effective length of the band from being lengthened.

9. The band clasp of claim 8, further comprising a pawl release that moves the opposing pawl inward so as to disengage the opposing pawl from the stop and allow the effective length of the band to be lengthened.

10. A wearable device, comprising:

a display carrier module;

a band operatively attached to the display carrier module; and a band clasp operatively attached to the band, the band clasp including:

a ratchet assembly at a first end of the band, the ratchet assembly including a plate having a rim that defines an aperture that extends along a length of the first end, the ratchet assembly further including a track that extends along the length of the first end beneath the plate, the track having a first side and a second side, the first side including a first plurality of teeth opposing a second plurality of teeth of the second side; and a pawl assembly disposed at a second end of the band opposite the first end, the pawl assembly including opposing pawls having an outward bias, the opposing pawls configured to engage the rim and opposing teeth of the track through the aperture to fasten the first end of the band to the second end of the band.

11. The wearable device of claim 10, wherein the display carrier module is configured to provide an indication of time.

12. The wearable device of claim 10, wherein the display carrier module includes a computing device.

13. The wearable device of claim 10, wherein the display carrier module includes a fitness tracking computing device.

14. The wearable device of claim 10, further comprising a heart rate sensor.

15. The wearable device of claim 14, wherein the aperture is positioned along an outward face of the first end of the band, and wherein the heart rate sensor is positioned along an inward face of the first end of the band, the inward face opposing the outward face with the first end of the band fastened to the second end of the band.

16. The wearable device of claim 10, wherein the ratchet assembly is in opposing abutment with the pawl assembly with the first end of the band fastened to the second end of the band.

17. A wearable sensor system, comprising:

a display carrier module;

a band operatively attached to the display carrier module, the band including a heart rate sensor positioned at a first end of the band; and a band clasp operatively attached to the band, the band clasp including:

a ratchet assembly at the first end of the band, the ratchet assembly including a plate having a rim that defines an aperture that extends along a length of the first end, the ratchet assembly further including a track that extends along the length of the first end beneath the plate, the track having a first side and a second side, the first side including a first plurality of teeth opposing a second plurality of teeth of the second side; and a pawl assembly disposed at a second end of the band opposite the first end, the pawl assembly including opposing pawls having an outward bias, the opposing pawls configured to engage the rim and opposing teeth of the track through the aperture to fasten the first end of the band to the second end of the band.

18. The wearable sensor system of claim 17, wherein the display carrier module is configured to provide output indicative of measurement performed by the heart rate sensor.

19. The wearable sensor system of claim 18, wherein the heart rate sensor is positioned along an inward face of the first end of the band, and wherein the track is positioned along an outward face of the first end of the band, the outward face opposing the inward face and the pawl assembly with the first end fastened to the second end.

20. The wearable sensor system of claim 17, wherein the ratchet assembly is in opposing abutment with the pawl assembly with the first end fastened to the second end.

* * * * *